US005297507A

United States Patent [19]

Ma

[11] Patent Number: 5,297,507

[45] Date of Patent: Mar. 29, 1994

[54] INTERNAL COMBUSTION ENGINE HAVING VARIABLE EVENT TIMING

[75] Inventor: Thomas T. Ma, Chelmsford, United Kingdom

[73] Assignee: Ford Motor Company, Dearborn, Mich.

[21] Appl. No.: 30,292

[22] Filed: Mar. 11, 1993

[30] Foreign Application Priority Data

Sep. 12, 1990 [GB] United Kingdom ..... 9019915

[51] Int. Cl.[5] ..... F01L 1/12

[52] U.S. Cl. ..... 123/90.17; 123/90.31; 464/1; 74/568 R

[58] Field of Search ..... 123/90.15, 90.17, 90.31; 464/1, 160; 74/568 R

[56] References Cited

U.S. PATENT DOCUMENTS

| | | | |
|---|---|---|---|
| 5,095,857 | 3/1992 | Hampton et al. | 123/90.17 |
| 5,181,484 | 1/1993 | Kan et al. | 123/90.17 |
| 5,181,486 | 1/1993 | Gyurovits | 123/90.17 |
| 5,219,313 | 6/1993 | Danieli | 123/90.17 |

FOREIGN PATENT DOCUMENTS

| | | |
|---|---|---|
| 3234640 | 3/1984 | Fed. Rep. of Germany . |
| 1095017 | 12/1967 | United Kingdom . |
| 2209061 | 4/1989 | United Kingdom . |

*Primary Examiner*—E. Rollins Cross
*Assistant Examiner*—Weilun Lo
*Attorney, Agent, or Firm*—Jerome R. Drouillard; Roger L. May

[57] ABSTRACT

An internal combustion engine has a crankshaft, a camshaft driven by the crankshaft through a drivewheel at half the crankshaft speed and at least one cam on the camshaft for actuating a spring-biased poppet valve. To achieve variable event timing, a lost motion coupling is arranged between the drive wheel and the camshaft. During the opening of the valve, the camshaft rotates at substantially the same speed as the drive wheel, but during the closing of a valve, the camshaft is accelerated by the valve spring to lead the drive wheel and thereby reduce the duration of the valve event. It is alternatively possible to collapse the opening phase of the valve event rather than the closing phase by reversing the operation of the coupling.

14 Claims, 2 Drawing Sheets

INTERNAL COMBUSTION ENGINE HAVING VARIABLE EVENT TIMING

FIELD OF THE INVENTION

The present invention relates to an internal combustion engine having variable event valve timing.

DESCRIPTION OF THE PRIOR ART

The optimum timing for the opening and closing of the inlet and exhaust valves of an internal combustion engine depends on engine speed and load and in any engine with a fixed valve timing, the shape of the cams and their phasing are selected to achieve an acceptable compromise for different operating conditions. It is therefore desirable to be able to vary at least the phasing but preferably also the event duration to match the valve timing to the operating conditions and thereby improve efficiency.

With this aim in mind, various proposals have been put forward to achieve variable event timing. Amongst such proposals have been the possibility of superimposing an oscillation on the rotation of the camshaft, the use of three dimensional cams, the use two cams with different profiles which may be selected by choice of rockers and the use of hydraulic tappets with controlled leakage. All such systems have the disadvantage of being complex and expensive to implement.

OBJECT OF THE INVENTION

The present invention seeks to provide an engine in which variable event timing can be achieved reliably and inexpensively.

SUMMARY OF THE INVENTION

According to one aspect of the present invention, an internal combustion engine has a crankshaft, a camshaft driven by the crankshaft through a drive wheel at half the crankshaft speed, and a plurality of cams on the camshaft for actuating respective spring biased poppet valves of the engine, wherein a spring biased lost motion coupling is arranged between the drive wheel and the camshaft so that during the opening of each valve the cam rotates at substantially the same speed as the drive wheel and during the closing of each valve the camshaft may be accelerated by the valve spring to lead the drive wheel and thereby reduce the duration of the valve events by altering the closing timing of the valves.

The invention is predicated on the realisation that whereas while a valve is being opened, resistance is encountered to the rotation of the camshaft by its drive wheel, while a valve is closing the camshaft is driven by the return spring and is braked by the rigidity of the coupling to the drive wheel. In other words, there are torque fluctuations experienced by the drive wheel. In the present invention, these torque fluctuations are relied upon to cause acceleration of the cams at the appropriate times to achieve the desired variation in the valve event duration. During opening of a valve, all lost motion is taken up by friction and the resistance of the valve spring and the timing of valve opening is still dictated by the drive wheel and the shape of the cam. On the other hand, during closing of a valve, the existence of lost motion permits the cam temporarily to move faster than the drive wheel and allow the valve to close at an earlier time than would have been possible with a rigid coupling.

The torque tending to accelerate the cam acts on elements having a fixed moment of inertia and will impart to them a predetermined angular acceleration. Because the angular acceleration is fixed, the amount of displacement will vary with the time available, in other words the slower the engine speed, the greater the reduction in valve event duration. This is precisely the variation which one wishes to achieve in that at high engine speed, the camshaft will behave like a rigid camshaft with long duration and substantial overlap between intake and exhaust events and at lower speeds the event duration is reduced progressively and the extent of overlap is also reduced progressively. A significant advantage of the invention, therefore, is that the cam drive mechanism requires no external control system to take varying speed into account and it can be entirely self-contained and self-regulating.

The rate of acceleration will depend on the strength of the valve springs and on the moment of inertia of the elements moving with the cams. By appropriate selection, these may be matched to achieve the desired variation of event duration with speed.

According to a second aspect of the present invention, there is provided an internal combustion engine having a crankshaft, a camshaft driven by the crankshaft through a drive wheel at half the crankshaft speed, and a plurality of cams on the camshaft for actuating respective spring biased poppet valves of the engine, wherein a spring biased lost motion coupling is arranged between the drive wheel and the camshaft so that during the closing of each valve the cam rotates at substantially the same speed as the drive wheel and during the opening of each valve the camshaft may be retarded by the valve spring to lag behind the drive wheel and thereby reduce the duration of the valve events by altering the opening timing of the valves.

The second aspect of the invention is essentially a corollary of the first, the difference being that spring biased lost motion is allowed in the coupling during the opening of the valves rather than during the closing. Thus, instead of opening the valves, the rotation of the drive wheel will compress the spring of the lost motion coupling and delay the opening time of the valve. During closing, the lost motion is taken up and the closing timing is fixed.

Because the lost motion coupling is arranged between the drive wheel and the camshaft, a single lost motion coupling is common to all the cylinders of the engine or at least of the bank. This has the advantage that the advance or retard of the valve closing or opening times will be the same for all cylinders, and the inertia of the entire camshaft determines the amount of acceleration or retardation, making for more predictable control.

However, one must take into account the phasing of the torque reversals brought about by all the cams. In an engine with four in-line cylinders, or an engine with banks of three cylinders but a single camshaft for each bank, the phasing does not prove appropriate for implementation of the invention.

However, in a V6 engine with dual overhead camshafts, each camshaft has three cams which are 120° apart and as each valve event also approximates to 120° there is excellent correlation between the graph of torque reversals versus time and the valve event diagram.

In such a V6 engine, there is no danger of the phase of the camshaft leading the drive wheel excessively as the slack in the lost motion coupling will be taken up immediately at the end of each 120° by the engagement of the next cam with its valve. Nevertheless, if such slack is taken up suddenly, undesired noise and vibration may result. It is therefore preferred that the lost motion coupling should include a shock absorber.

The invention is not however restricted to V6 DOHC engines and may be used with an engine having a smaller number of cylinders in each bank, such as a V4.

If desired, a damper may be arranged in the lost motion coupling to reduce the amplitude of the event variation if the system inertia is too low.

The torque variations with time are not in practice evenly balanced in both direction as the reversals are partly neutralised by friction in the valve train. To maximise the event duration variation effected by the reversals, the lost motion coupling may be spring biased with a force balancing the resistance presented by friction.

Conveniently, a shock absorber of moulded rubber may be used to limit noise, damp the movement and maintain the structural integrity of the assembly of the lost motion coupling.

It has been assumed that the valve springs alone provide sufficient torque fluctuation to achieve the desired variation in valve event but this need not necessarily be the case since it is possible to introduce additional torque fluctuations by providing a separate cam on the camshaft interacting with spring biased followers appropriately positioned about the camshaft.

If the followers are mounted in a housing rotatable about the axis of the camshaft, then the angular positioning of the followers may be varied to permit the valve event duration to be varied in dependence upon parameters other than engine speed, for example engine load.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 2:
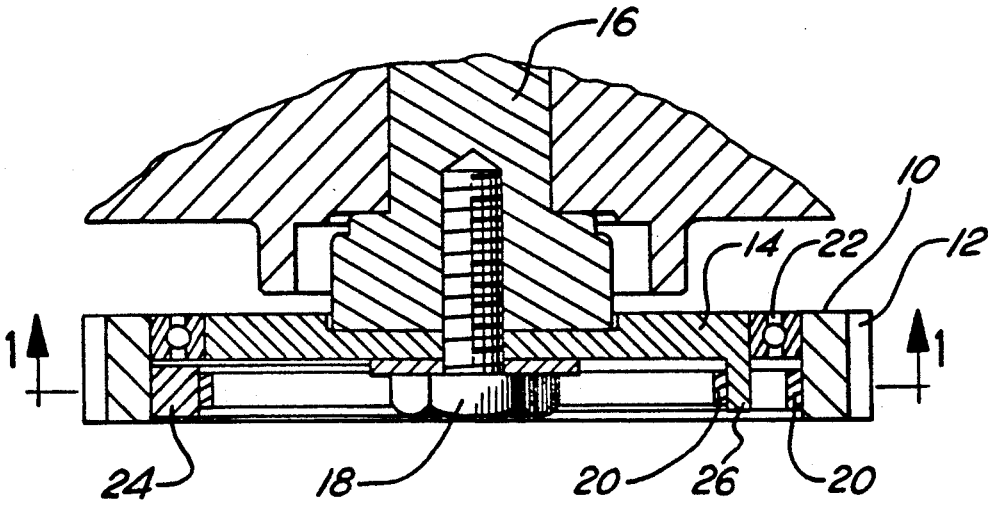
FIG. 2 is a section through the drive wheel of FIG. 1 taken along the line II—II in FIG. 1.
Figure 1:
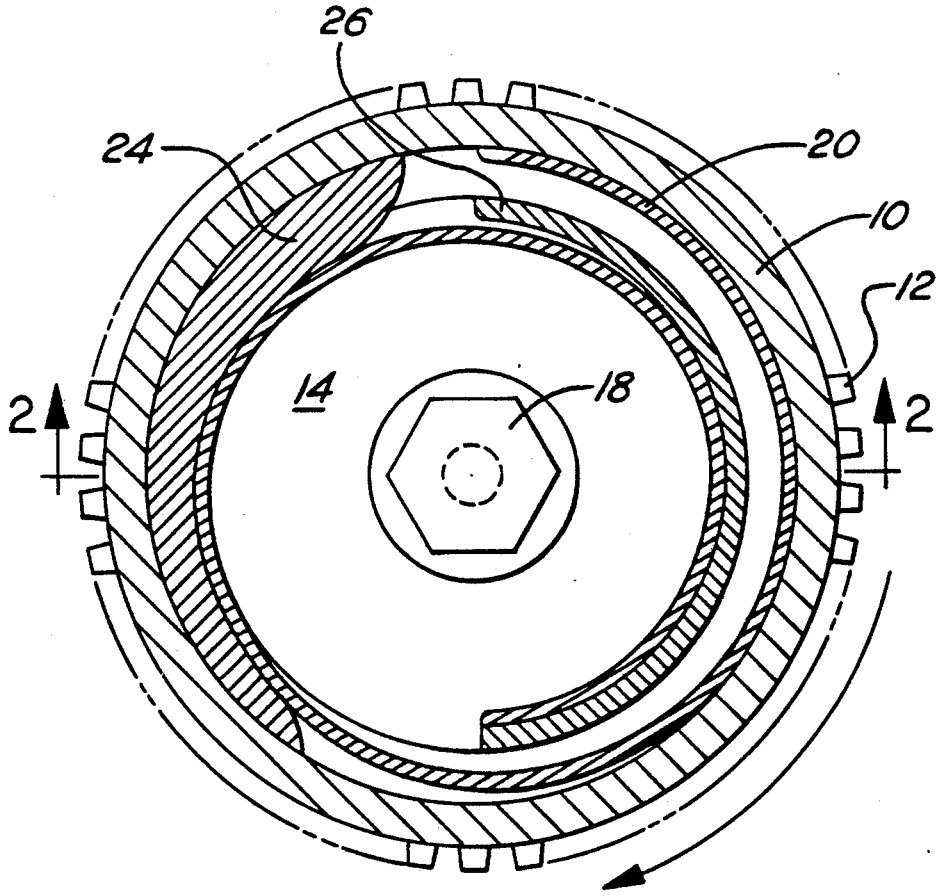
FIG. 1 is a section through a drive wheel for connecting a camshaft to crankshaft and including a lost motion coupling to enable variable event timing to be achieved.

FIGS. 1 and 2 show a drive wheel which comprises a central hub 14 secured to the camshaft 16 by means of a bolt 18 and surrounded by a ring 10 which is journalled by a bearing 22 on the hub 14 and has teeth 12 which are engaged by a toothed belt (not shown) which also passes around a crankshaft pulley.

Torque is transmitted from the toothed ring 10 to the hub 14 through a spiral spring 20 which is secured at one end to the inner surface of the ring 10 and at its other end to an arcuate rim 26 projecting from the central hub 14. A rubber buffer or shock absorber 24 is mounted on the inner surface of the ring 10 and acts as a stop to prevent unwinding of the spiral spring 20.

The outer toothed ring 10 is driven in the direction shown by an arrow in FIG. 1 which tends to unwind the spring 20 if its other end encounters resistance from the central hub 14. The spring cannot unwind beyond the point where it is in contact with the inner surface of the ring 10, with the inner surface of the buffer 24 and with the inner surface of the rim 26 and in this position of the spring 20, the central hub 14 and the outer toothed ring 10 are effectively solid with one another and rotate in unison.

If driving one camshaft of a DOHC V6 or V4 engine, the inlet events of the various cylinders are separated in time and do not overlap one another. In this case, whenever a valve is being opened, the camshaft will encounter resistance to its rotation and force the spring 20 to its illustrated position in which the outer toothed ring 10 is fast in rotation with the central hub 14. Thus, the opening timing of the valves is fixed and does not depend on the spring 20 in any way.

When any of the valves is closing, the camshaft will undergo a torque reversal in that the force on the camshaft from the valve spring will tend to make the camshaft 16 turn faster than the toothed wheel 10 instead of offering resistance to the rotation of the crankshaft. In this case, the spiral spring 20 is being wound up and this is resisted only by the resilience of the spring. During the closing of the valves, therefore, the camshaft can wind up the spring 20 and in the process advance the closing time of the valves.

With the opening of the next valve, the spring 20 unwinds gradually and rolls into contact with the buffer 24 so that the return to a driving relation between the toothed wheel 10 and the central hub 14 takes place without noise or snatching.

The extent to which the spring 20 is wound up by the torque reversal on the camshaft depends on the time available and the inertia of the rotating masses. As the inertia is fixed, the extent of timing advance depends upon speed and increases with reducing engine speed.

Therefore as the speed is reduced, the valve event is automatically collapsed on its closing side while the opening side remains unaltered. This can be used on the inlet or the exhaust valves.

Figure 3:
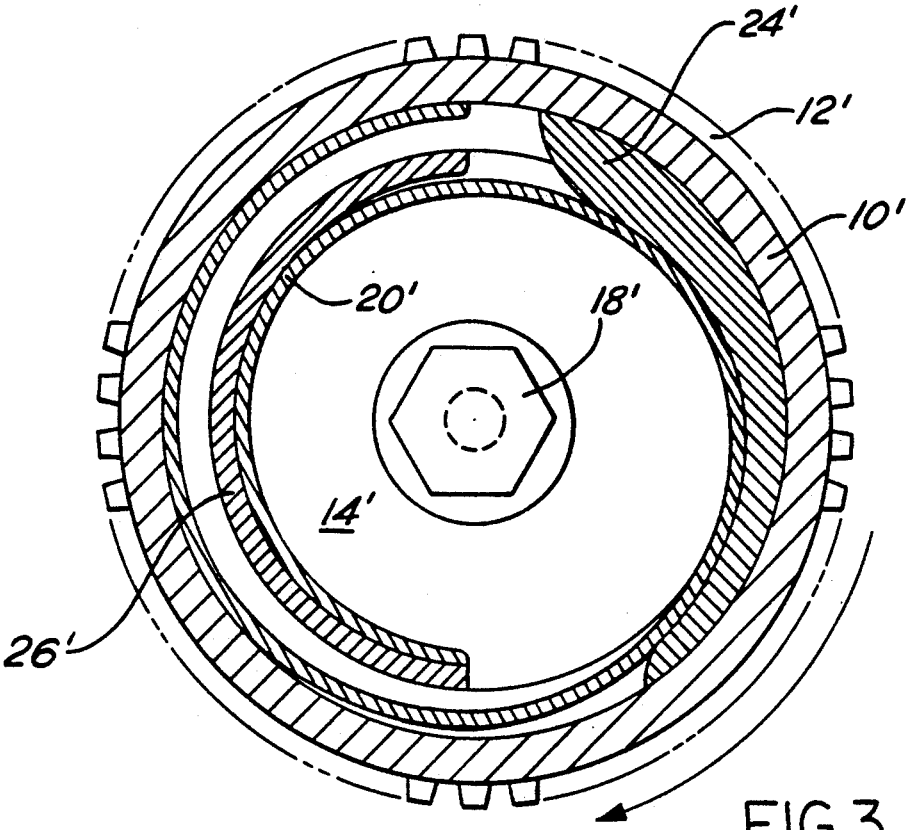
FIG. 3 is a view similar to that of FIG. 1 showing an embodiment of the invention in which the opening timing is varied rather than the closing timing and FIG. 4 is a section through an arrangement for imposing torque fluctuations on the camshaft in addition to those imposed by the return springs of the poppet valves.

It is not in fact essential that the closing phase be varied and the opening phase be fixed since by reversing the direction of winding up of the spiral spring 20 the opposite can be achieved, as shown in the embodiment of FIG. 3. In this embodiment, like reference numerals have been used to refer to like components and a prime has been added to avoid confusion. It will be obvious, without the need for further description, that when drive is transmitted from the toothed ring 10′ to the central hub 14′ and resistance is encountered by the camshaft, the spiral spring 20′ will tend to wind up and retard the opening of the valves whereas valve closing timing will be fixed by the spring 20′ unwinding and abutting the buffer 24′. The valve event is now reduced with decreasing engine speed by the collapse of the opening side of the event. If such drive wheels are used on inlet and exhaust camshaft, it is possible not only to vary the valve duration but also the valve overlap and all variations take place in the desired direction as speed changes without the need for any external control system.

It will be noted that in both embodiments there is a certain degree of motion permitted in only one direction of relative motion between the ring 10 or 10′ and the central hub 14 or 14′. The drive wheel thus includes a lost motion coupling which is biased in one direction so that in one direction of movement relative movement is not allowed and only relative movement in the opposite direction is allowed, opposed by the action of a spring. This arrangement means that the timing of the valve opening peak does not vary and it is not possible to set up oscillations in the spring 20 and the coupling.

This is to be contrasted with prior proposals to provide a totally flexible coupling in which drag on the camshaft is averaged out over an engine cycle and used to compress a spring which acts in the opening direction of the valve. In this case, all that is achieved is a phase shift, not a change in event duration, and the amount of phase shift is drag dependent. This is not acceptable as the drag varies with factors other than engine speed. Furthermore, the coupling is resilient about a central position and there is nothing to stop uncontrolled oscillation of the coupling.

Figure 4:
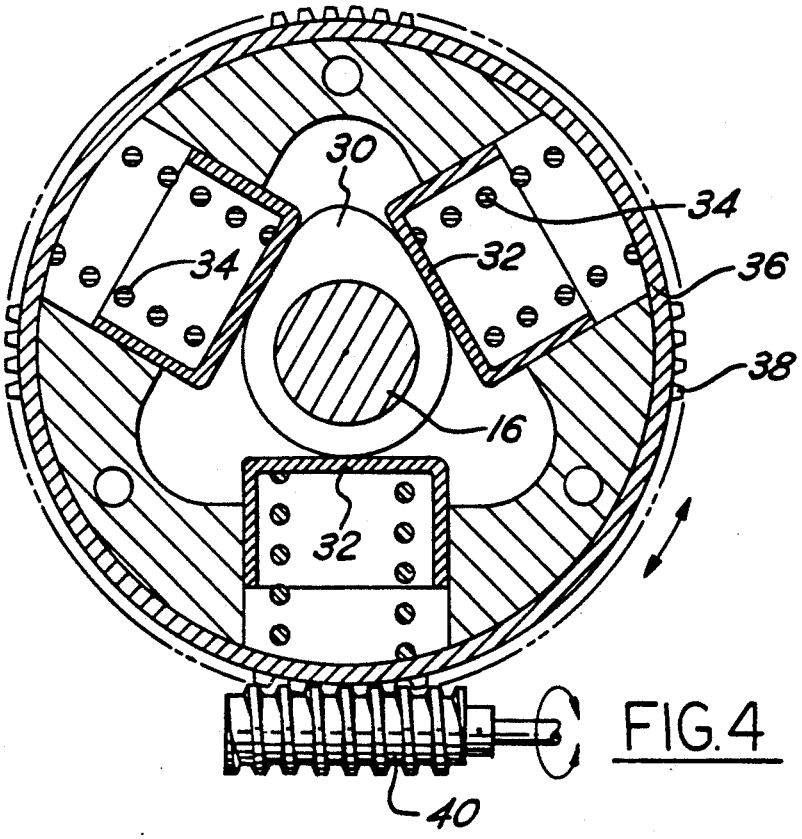

As described above, the variation in valve timing is determined exclusively by naturally occurring torque fluctuations on the camshaft, that is to say fluctuations caused exclusively by the valve springs. If desired to vary the timing by different amounts or at different times, then is it possible to superimpose torque fluctuations on the camshaft by an arrangement as shown in FIG. 4.

An additional cam 30 is formed on the camshaft 16 which engages three cam followers 32 biased by springs 34, the followers being buckets slidably received in a housing 36. The springs 34 can now be dimensioned at will to apply the desired amount of reaction torque to the camshaft 16 and one is not constrained in the same manner as when selecting valve springs. Furthermore, the timing of the superimposed torque fluctuation wave can be selected at will to enhance or detract from the naturally occurring torque fluctuations. Furthermore, by controlling the angular position of the housing 36 about the axis of the camshaft 16 one can dynamically vary the torque reaction during operation, for example in response to sensing a control parameter such as engine load. In the illustrated embodiment, the housing 36 has teeth 38 engaged by a worm wheel 40 to allow its angular position to be varied.

I claim:

1. An internal combustion engine having a crankshaft, a camshaft (16) driven by the crankshaft through a drive wheel (10) at half the crankshaft speed, and a plurality of cams on the camshaft (16) for actuating respective spring biased poppet valves of the engine, characterised in that a spring biased lost motion coupling (10, 20, 14) is arranged between the drive wheel (10) and the camshaft (16) so that during the opening of each valve the camshaft (16) rotates at substantially the same speed as the drive wheel (10) and during the closing of each valve the camshaft (16) may be accelerated by the valve spring to lead the drive wheel (10) and thereby reduce the duration of the valve events by altering the closing timing of the valves.

2. An internal combustion engine having a crankshaft, a camshaft (16) driven by the crankshaft through a drive wheel (10) at half the crankshaft speed, and a plurality of cams on the camshaft (16) for actuating respective spring biased poppet valves of the engine, characterised in that a spring biased lost motion coupling (10, 20, 14) is arranged between the drive wheel (10) and the camshaft (16) so that during the closing of each valve the camshaft (16) rotates at substantially the same speed as the drive wheel (10) and during the opening of each valve the camshaft (16) may be retarded by the valve spring to lag behind the drive wheel (10) and thereby reduce the duration of the valve events by altering the opening timing of the valves.

3. An internal combustion engine as claimed in claim 1, characterised in that the engine is a V6 engine with dual overhead camshafts, each camshaft having cams for three cylinders disposed 120° apart.

4. An internal combustion engine as claimed in claim 1, characterised in that each lost motion coupling includes a shock absorber (24) to reduce noise when lost motion is taken un.

5. An internal combustion engine as claimed in claim 4, characterised in that a damper is included in each lost motion coupling to reduce the amplitude of the event variation.

6. An internal combustion engine as claimed in claim 4, characterised in that each lost motion coupling is spring biased in one direction to balance the effect of valve train friction.

7. An internal combustion engine as claimed in claim 4, characterised in that the shock absorber (24) is formed of moulded rubber.

8. An internal combustion engine as claimed in claim 4, characterised in that an additional cam (30) is provided on the camshaft (16) interacting with spring biased followers (32) to impose additional torque fluctuations on the camshaft (16) during rotation.

9. An internal combustion engine as claimed in claim 8, characterised in that the followers (32) are mounted in a housing (38) rotatable about the axis of the camshaft (16), whereby the angular position of the followers may be varied by rotation of the housing (38) to vary the phase of the additional torque fluctuations relative to the fluctuations caused by the valve springs.

10. An internal combustion engine as claimed in claim 2, wherein the engine is a V6 engine with dual overhead camshafts, each camshaft having cams for three cylinders disposed 120° apart.

11. An internal combustion engine as claimed in claim 2, wherein each lost motion coupling includes a shock absorber (24) to reduce noise when lost motion is taken up.

12. An internal combustion engine as claimed in claim 11, wherein a damper is included in each lost motion coupling to reduce the amplitude of the event variation.

13. An internal combustion engine as claimed in claim 11, wherein an additional cam (30) is provided on the camshaft (16) interacting with spring biased followers (32) to impose additional torque fluctuations on the camshaft (16) during rotation.

14. An internal combustion engine as claimed in claim 13, wherein the followers (32) are mounted in a housing (38) rotatable about the axis of the camshaft (16), whereby the angular position of the followers may be varied by rotation of the housing (38) to vary the phase of the additional torque fluctuations relative to the fluctuations caused by the valve springs.

* * * * *